United States Patent [19]

Lavik

[11] 4,194,367

[45] Mar. 25, 1980

[54] APPARATUS FOR PRODUCING ICE

[75] Inventor: Ingvar Lavik, Gjettum, Norway

[73] Assignee: A/S Finsam Industries Ltd., Grimstad, Norway

[21] Appl. No.: 911,042

[22] Filed: May 30, 1978

[51] Int. Cl.[2] ..... F25B 43/00

[52] U.S. Cl. ..... 62/138; 62/233; 62/503

[58] Field of Search ..... 62/512, 352, 277, 81, 62/233, 138, 503

[56] References Cited

U.S. PATENT DOCUMENTS

| | | | |
|---|---|---|---|
| 3,067,590 | 12/1962 | Wood, Jr. | 62/512 X |
| 3,251,195 | 5/1966 | Guetschow | 62/352 X |
| 3,487,656 | 1/1970 | Grant | 62/512 X |
| 3,680,324 | 8/1972 | Garland | 62/512 X |
| 3,922,875 | 12/1975 | Morris, Jr. | 62/352 X |
| 4,094,168 | 6/1978 | Hamner et al. | 62/352 X |
| 4,107,943 | 8/1978 | Ohling | 62/352 X |

*Primary Examiner*—Albert J. Makay
*Assistant Examiner*—William E. Tapolcai, Jr.
*Attorney, Agent, or Firm*—Watson, Cole, Grindle & Watson

[57] ABSTRACT

In an apparatus for producing ice a compressor which via a liquid separator is supplied with cooling medium from an evaporator, transfers compressed medium to a condenser, the condenser being connected to a liquid collector which in turn is connected to the evaporator. A first controllable valve is connected in the communication path between the liquid collector and the evaporator, and a second controllable valve is connected in the return path between the liquid separator and the evaporator. The first controllable valve is closed during the freezing period and open during the thawing period, whereas the second controllable valve is open during the freezing period and closed during the thawing period, so that the condensate from the condenser during the freezing period is accumulated in the liquid collector without being transferred to the evaporator, a self-circulation of the cooling medium taking place between the liquid separator and the evaporator, and so that the self-circulation of the cooling medium between the liquid separator and the evaporator is stopped during the thawing period and the accumulated condensate in the liquid collector is supplied to the liquid separator via the evaporator, the condensate giving off heat to the evaporator.

4 Claims, 3 Drawing Figures

APPARATUS FOR PRODUCING ICE

BACKGROUND OF THE INVENTION

1. Field of the Art

The present invention relates to an apparatus for producing ice, comprising a compressor which via a liquid separator is supplied with cooling medium from an evaporator, and which transfers compressed medium to a condenser, the condenser being connected to a liquid collector which in turn is connected to the evaporator.

2. Description of Prior Art

There is previously known a series of types of apparatus or machines for producing ice. In such known machines, water is supplied to the machine during the freezing process at the top of plate-shaped ice-making bodies. The water is permitted to flow or trickle down along the bodies whilst passing a freezing medium through passages therein. A portion of the water flowing along the ice-making bodies will then freeze, whereas surplus water is caught by subjacent gutters for removal and possibly recirculation. When the ice layer on the bodies has reached an appropriate thickness, for example after a freezing operation of the machine of approximately 10–15 minutes, the supply of water is stopped, and a thawing medium is passed through the passages in the bodies, the medium heating the bodies sufficiently for the inner stratum of the ice layer to melt. The ice will then slide or fall down from the ice-making bodies in larger or lesser flakes and fall down between the gutters into an ice container or an ice magazine, usually via a crushing device which fractionates the ice in suitable pieces. When all the ice has been loosened, the freezing process is restarted.

The heating of the ice-making bodies usually takes place in the supply of high pressure gas from the pressure side of the cooling compressor to the evaporators, in which the gas gives off condensing heat.

In the following, two previously known apparatus will be described in detail, reference being had to FIG. 1 and FIG. 2, respectively.

Figure 1:
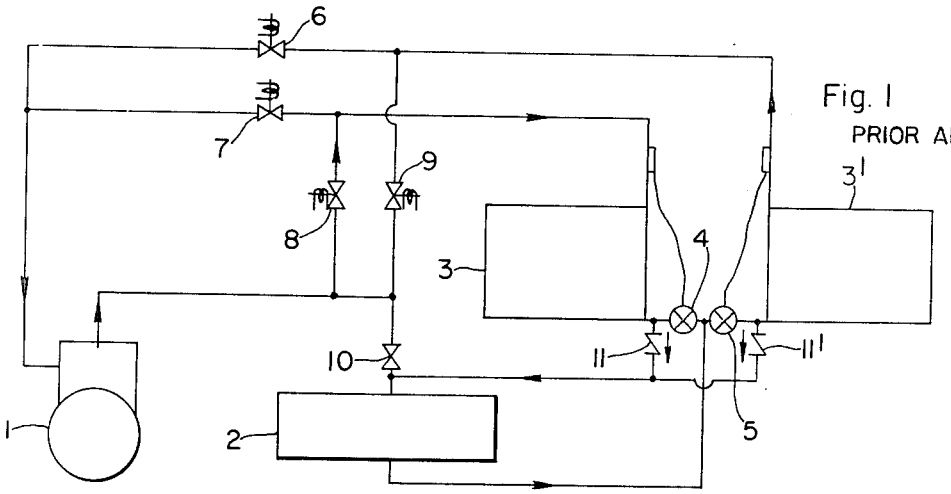
Fig. 1 PRIOR ART
FIGS. 1 and 2 show refrigeration systems according to the prior art.

In FIG. 1, there is diagrammatically illustrated a first apparatus or system which is used for the production of ice. The apparatus comprises a compressor 1, a condenser 2, two evaporators 3 and 3', each of which having an expansion valve 4 and 5, respectively, as well as associated pipe conduits including magnet valves 6, 7, 8, 9 and 10. It is to be understood that the function of the apparatus involves that only one evaporator is subjected to thawing at a time, the other evaporator then functioning as an ice-making body. In the Figure the arrows indicate the flow of direction of the cooling medium when the evaporator 3 is subjected to thawing. The magnet valves 6 and 8 are then open, whereas the valves 7, 9 and 10 are closed.

The condensate produced in the evaporator 3 is passed via a non-return valve 11 to the condenser 2 and further on via the thermostatic expansion valve 5 to the evaporator 3' wherein it is re-evaporated. It is also to be understood that both evaporators 3 and 3', for certain periods, may be used as ice-making bodies, and in such an operating modus the magnet valves 6, 7 and 10 will be open, whereas the valves 8 and 9 will be closed.

Figure 2:
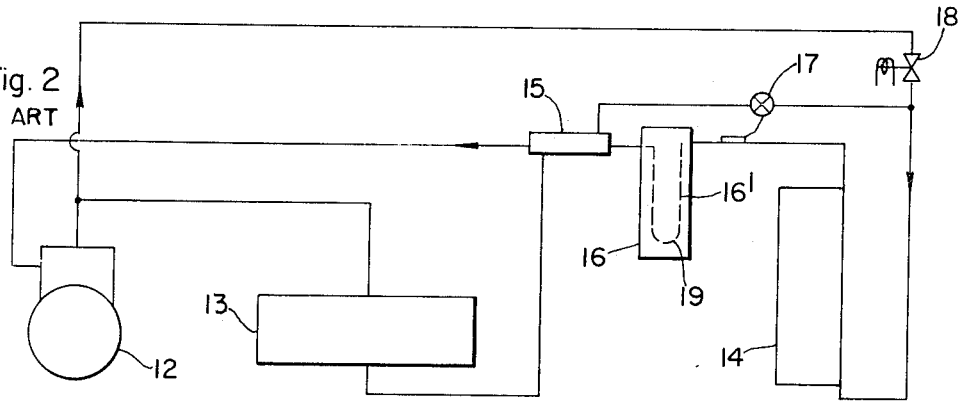
Fig. 2 PRIOR ART

In FIG. 2 there is illustrated another previously known apparatus for producing ice. This system also comprises a compressor 12 and a condenser 13. Further, the apparatus in FIG. 2 comprises an evaporator 14, a heat exchanger 15, a liquid accumulator 16, a thermostatic expansion valve 17 and a magnet valve 18. The arrows indicated in FIG. 2 illustrate the flow of direction of the cooling medium when the evaporator 14 is subjected to thawing. The cooling medium housed in the evaporator 14 at the commencement of the thawing operation will upon the opening of the magnet valve 18 be pressed out of the evaporator 14 and into the liquid accumulator 16. From the accumulator 16 the portion of the freezing medium which has been evaporated, will be sucked out through a pipe 16', whereas the liquid portion of the freezing medium which is gathered at the bottom of the liquid accumulator 16, will be mixed with the evaporated portion of the freezing medium through a small opening 19 in the pipe 16' and together with the evaporated portion flow through the accumulator 16 to the compressor 12.

When the cooling medium is circulated as illustrated in FIG. 2, the evaporator 14 will have supplied to it a quantity of heat per time unit which practically speaking corresponds to the motor power absorbed by the compressor 12.

The apparatus illustrated in FIGS. 1 and 2 suffer from certain disadvantages. In both apparatus it is necessary to use thermostatic expansion valves to which there are severe requirements as to correct mounting and adjustment for such valves to operate satisfactorily. Further, such thermostatic expansion valves may often be the cause of irregularities in operation. Besides, the system of FIG. 1 involves substantial automation equipment, a fact which increases the installation costs and reduces the reliability of the service.

SUMMARY OF THE PRESENT INVENTION

The object of the present invention is to remedy the above-mentioned disadvantages. According to the invention, in an apparatus of the type specified in the preamble, this object is achieved by a first controllable valve which is connected in the communication path between the liquid collector and the evaporator, and which during the freezing period is closed and during the thawning period is open, and by a second controllable valve which is connected in the return path between the liquid separator and the evaporator, and which is open during the freezing period and closed during the thawing period, so that the condensate from the condenser during the freezing period is accumulated in the liquid collector without being transferred to the evaporator, a self-circulation of the cooling medium taking place between the liquid separator and the evaporator, and so that the self-circulation of the cooling medium between the liquid separator and the evaporator is stopped during the thawing period, and the accumulated condensate in the liquid collector is supplied to the liquid separator via the evaporator, the condensate giving off heat to the evaporator.

In other words, the invention is to the effect that in a system wherein the thawing takes place regularly at relatively short intervals, the condensate is collected during the freezing period and supplied to the evaporator only each time the thawing is to take place. Thereby, also a portion of the heat stored in the condensate may be utilized for the heating of the ice-making surfaces of the evaporator. The thawing cycles may be controlled either by a timer means or means sensing the thickness of the ice layer.

It is to be observed that the liquid collector is designed with sufficient capacity for collecting the condensate produced during the freezing period, and that the liquid separator has sufficient capacity for housing as much liquid as is condensed during the freezing period.

DESCRIPTION OF A PREFERRED EMBODIMENT

In the following a preferred embodiment of the invention will be described, reference being had to FIG. 3.

Figure 3:
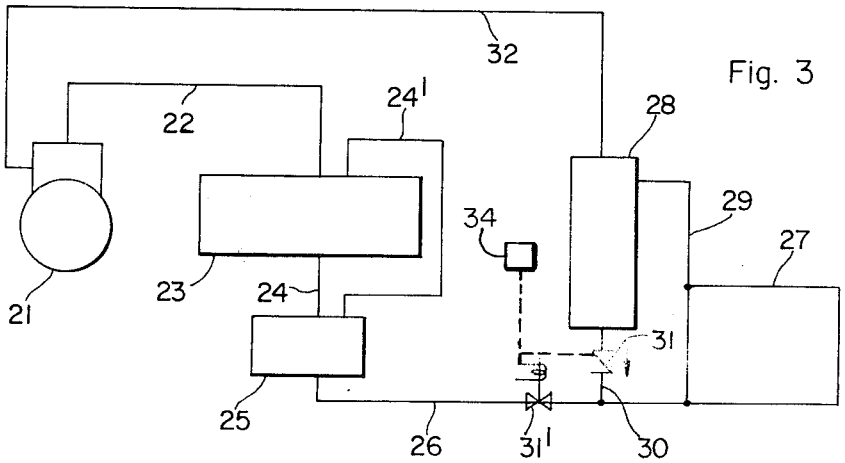
FIG. 3 shows a schematic view of a refrigeration system according to the present invention.

The apparatus according to the invention as illustrated in FIG. 3, comprises a compressor 21 which via a conduit 22 is connected to a condenser 23. This in turn is via a conduit 24 connected to a liquid collector 25 which in turn via a conduit 26 is connected to an evaporator 27. A conduit 24' serves for equalizing the pressure in the condenser 23 and the liquid collector 25. A liquid separator 28 is connected to the evaporator 27, both via a conduit 29 and a branch conduit 30. In the branch conduit 30 there is provided a non-return valve 31, whereas a magnet valve 31' is provided in the conduit 26 between the liquid collector 25 and the connection point of the conduit 26 and the branch conduit 30. A conduit 32 connects the liquid separator 28 to the compressor 21.

During the freezing cycle the magnet valve 31' is closed. Cooling medium in the form of liquid and being housed in the liquid separator 28, will then via the valve 31 and the branch conduit 30 serving as a down pipe, be supplied to the evaporator 27. In the evaporator 27 there occurs a partial evaporation of the cooling medium and the evaporated cooling medium is passed back to the liquid separator 28 via the conduit 29. The evaporated cooling medium is sucked off through the suction conduit 32, is compressed in the compressor 21 and supplied to the condenser 23 through the pressure conduit 22. The condensed cooling medium flows down into the liquid collector 25, wherein the condensate is accumulated whilst the quantity of liquid in the liquid separator 28 is reduced correspondingly. During this sucking-off process there is established a self-circulation of cooling medium between the liquid separator 28 and the evaporator 27.

After a certain freezing period depending on the freezing time elapsed or the desired thickness of the ice layer, the ice is to be loosened from the ice-making bodies of the evaporator, i.e. the evaporator is to be subjected to thawing. Such a reversal of the mode of operation is accomplished in opening the magnet valve 31' concurrently with the closing of the valve 31. The valve 31 may for example be a non-return valve which is closed due to the difference in pressure, or a magnet valve which is closed in response to a pulse from an appropriate controlling automation means 34. When the valve 31 is closed and the valve 31' is open, liquid in the liquid collector 25 flows to the evaporator 27 and on to the liquid separator 28. During the transport through the cold evaporator 27, the liquid gives off heat. The ice-making bodies in the evaporator are then heated, and there is produced a water film between the ice layer and the ice-making bodies for the loosening of the ice therefrom. When the liquid collector 25 is emptied, the compressor 21 continues the transport of cooling medium through the conduit 26 to the evaporator 27.

During the thawing phase the delivery of heat in the condenser 23 must be reduced to approximately zero. In connection with air cooled condensers this may take place in that the condenser fans (not illustrated) are stopped, and in connection with water cooled condensers in that the condensers are equipped with an automatic water valve (not illustrated) which is closed when the pressure in the condenser 23 decreases below a certain value. The low pressure side in the system will then be supplied with a quantity of heat per time unit which practically speaking corresponds to the motor power absorbed by the compressor.

The liquid collector 25 must be large enough to hold the condensate developed during the freezing period, whereas the liquid separator 28 must be so designed that the maximum liquid level during the thawing period and at the start of the freezing period does not involve the risk of liquid hammering, whereas the lowest level immediately prior to the end of the freezing period must be sufficiently high to maintain the self-circulation of the cooling medium through the evaporator 27.

The valves 31 and 31' may be connected to an appropriate automation controlling means 34 such as an adjustable timing means, which depending on its setting, changes the valves between open and closed position. As an alternative, the valves may be connected to an adjustable means sensing the thickness of the ice layer and changing the valves between open and closed position when the ice layer gains a certain thickness.

The apparatus according to the present invention is especially favourable for smaller units. It is true that compared with known apparatus there is required a larger number of containers, but this is balanced by the reduced requirement of automation means, the apparatus according to the invention also offering a better utilization of the ice-making bodies in the evaporator.

What I claim is:

1. An apparatus for producing ice comprising a compressor which via a liquid separator is supplied with cooling medium from an evaporator and which transfers compressed medium to a condenser, the condenser being connected to a liquid receiver which in turn is connected to the evaporator, the improvement comprising a first controllable valve which is connected in a communication path between the liquid receiver and the evaporator, and which during the freezing period is closed and during the thawing period is open so that condensate from the condenser is accumulated in the liquid receiver without being transferred to the evaporator during the freezing period, and a second controllable valve, which is connected in a return path between the liquid separator and the evaporator, and which is open during the freezing period and closed during the thawing period and means for controlling the first and second valves so that during the freezing period, a self-circulation of the cooling medium taking place between the liquid separator and the evaporator, and so that during the thawing period, the self-circulation of the cooling medium between the liquid separator and the evaporator is stopped and the accumulated condensate in the liquid receiver is supplied to the liquid separator via the evaporator, the condensate giving off heat to the evaporator.

2. Apparatus as claimed in claim 1, wherein the means for controlling comprises an adjustable timing means which sequentially changes the valves between the open and closed positions.

3. Apparatus as claimed in claim 1, wherein the means for controlling comprises an adjustable means sensing the thickness of the ice layer which changes the valves between open and closed position when the ice layer reaches a certain thickness.

4. A refrigeration system adapted to cycle alternately through a refrigeration cycle and a defrost cycle, comprising a compressor having discharge and suction ports, a condenser having an inlet connected to the discharge port of the compressor so as to receive compressed cooling medium therefrom, a liquid receiver connected to the condenser to receive condensed cooling medium flowing therefrom, means for equalizing the pressure in the condenser and the liquid receiver, an evaporator connected to the liquid receiver by a communication path which includes a first controllable valve which is closed during the refrigeration cycle and open during the defrost cycle, a liquid separator connected to the suction port of the compressor, said liquid separator also being connected to the evaporator by both a forward conduit and a return conduit which communicates with the communication path downstream of the first controllable valve therein, a second controllable valve being included in the return conduit and adapted to be open during a refrigeration cycle and closed during a defrost cycle, and means for controlling the first and second valves such that during the refrigeration cycle, the first controllable valve is closed and the second controllable valve is open, the condensate from the condenser being accumulated in the liquid receiver without being transferred to the evaporator whilst the quantity of liquid cooling medium in the liquid separator is reduced correspondingly by a self-circulation of the cooling medium taking place between the liquid separator and the evaporator, and during the defrost cycle said controllable valves are reversed, the accumulated condensate from the liquid receiver being supplied to the evaporator and the liquid separator for giving off heat to the cold evaporator.

* * * * *